US010928064B2

(12) United States Patent
Cadima et al.

(10) Patent No.: US 10,928,064 B2
(45) Date of Patent: Feb. 23, 2021

(54) PNEUMATIC ACTUATING INJET VALVE WITH DELAYED SHUTOFF

(71) Applicant: Haier US Appliance Solutions, Inc., Wilmington, DE (US)

(72) Inventors: Paul Bryan Cadima, Crestwood, KY (US); Hans Juergen Paller, Louisville, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 151 days.

(21) Appl. No.: 16/255,032

(22) Filed: Jan. 23, 2019

(65) Prior Publication Data

US 2020/0232640 A1 Jul. 23, 2020

(51) Int. Cl.

| | |
|---|---|
| ***F23D 14/22*** | (2006.01) |
| ***F23N 1/02*** | (2006.01) |
| ***F23N 5/18*** | (2006.01) |
| ***F23D 14/60*** | (2006.01) |
| *F23D 14/34* | (2006.01) |

(52) U.S. Cl.

CPC ..... *F23D 14/22* (2013.01); *F23D 14/60* (2013.01); *F23N 1/025* (2013.01); *F23N 5/187* (2013.01); *F23D 14/34* (2013.01); *F23N 2231/00* (2020.01); *F23N 2235/24* (2020.01); *F23N 2239/04* (2020.01); *F23N 2241/00* (2020.01)

(58) Field of Classification Search

CPC ..... F23D 14/22
USPC ..... 431/90, 62, 56, 265
See application file for complete search history.

(56) References Cited

U.S. PATENT DOCUMENTS

| | | | | |
|---|---|---|---|---|
| 2,939,524 | A * | 6/1960 | Mathis | F23N 1/007 236/99 R |
| 3,314,604 | A * | 4/1967 | Branson | H05B 1/0208 236/80 R |
| 3,606,612 | A * | 9/1971 | Reid | F23D 14/145 431/281 |
| 3,701,598 | A * | 10/1972 | Katchka | A24C 5/52 137/599.09 |
| 4,060,370 | A | 11/1977 | Fleer | |
| 4,413,975 | A * | 11/1983 | Turner | F23N 5/105 431/56 |
| 5,520,533 | A * | 5/1996 | Vrolijk | F23N 1/027 431/90 |
| 5,765,542 | A * | 6/1998 | Fey | F24C 3/085 126/39 BA |

(Continued)

FOREIGN PATENT DOCUMENTS

JP 4565203 B2 10/2010

*Primary Examiner* — Avinash A Savani
(74) *Attorney, Agent, or Firm* — Dority & Manning, P.A.

(57) ABSTRACT

An injet for a gas burner includes a first gas orifice and a second gas orifice. An injet body defines an air passage and a gas passage. The first and second gas orifices are mounted to the injet body. A pneumatically actuated gas valve blocks a flow of gaseous fuel through the gas passage to the second gas orifice in a closed configuration. The pneumatically actuated gas valve is configured to adjust from the closed configuration to an open configuration in response to a flow of air through the air passage. A flow restriction body is disposed upstream of the pneumatically actuated gas valve. The flow restriction body defines a through hole via which air is flowable to pneumatically actuated gas valve.

18 Claims, 11 Drawing Sheets

(56) References Cited

U.S. PATENT DOCUMENTS

| | | | | |
|---|---|---|---|---|
| 2003/0013056 | A1* | 1/2003 | Fredricks | F23D 14/60 431/90 |
| 2010/0279238 | A1* | 11/2010 | Harneit | F23L 1/00 431/144 |
| 2012/0090595 | A1* | 4/2012 | Shaffer | F23N 1/002 126/39 E |

* cited by examiner

PNEUMATIC ACTUATING INJET VALVE WITH DELAYED SHUTOFF

FIELD OF THE INVENTION

The present subject matter relates generally to gas burners, such as forced induction gas burners.

BACKGROUND OF THE INVENTION

Conventional gas cooking appliances have one or more burners. A mixture of gaseous fuel and air combusts at the burners to generate heat for cooking. Known burners frequently include an orifice and Venturi mixing throat. A jet of gaseous fuel between the orifice and the Venturi mixing throat entrains air into the Venturi mixing throat with the jet of gaseous fuel. The air and gaseous fuel mix within the Venturi mixing throat, and the mixture of gaseous fuel and air is combusted at flame ports of the burners. Such burners are generally referred to as naturally aspirated gas burners.

Naturally aspirated gas burners can efficiently burn gaseous fuel. However, a power output of naturally aspirated gas burners is limited by the ability to entrain a suitable volume of air into the Venturi mixing throat with the jet of gaseous fuel. To provide increased entrainment of air, certain gas burners include a fan or pump that supplies pressurized air for mixing with the jet of gaseous fuel. Such gas burners are generally referred to as forced induction gas burners.

While offering increased power, known forced induction gas burners suffer from various drawbacks. For example, the forced induction gas burner can extinguish abruptly when the pressurized air is quickly shut off. In addition, known forced induction gas burners are bulky and occupy large volumes within cooktop appliances, and plumbing of the gas/air lines within known forced induction gas burners is complex and costly.

BRIEF DESCRIPTION OF THE INVENTION

Aspects and advantages of the invention will be set forth in part in the following description, or may be apparent from the description, or may be learned through practice of the invention.

In a first example embodiment, an injet for a gas burner includes a first gas orifice and a second gas orifice. An injet body defines an air passage and a gas passage. The first and second gas orifices are mounted to the injet body. The first gas orifice is spaced from the second gas orifice on the injet body. The gas passage is configured for directing gaseous fuel through the injet body to the first and second gas orifices. A pneumatically actuated gas valve is adjustable between a closed configuration and an open configuration. The pneumatically actuated gas valve blocks a flow of gaseous fuel through the gas passage to the second gas orifice in the closed configuration. The pneumatically actuated gas valve is configured to adjust from the closed configuration to the open configuration in response to a flow of air through the air passage. A flow restriction body is disposed upstream of the pneumatically actuated gas valve. The flow restriction body defines a through hole via which air is flowable to pneumatically actuated gas valve.

In a second example embodiment, a gas burner includes a burner body that defines a plurality of naturally aspirated flame ports and a plurality of forced induction flame ports. The gas burner also includes a first gas orifice and a second gas orifice. An injet body defines an air passage and a gas passage. The gas passage is configured for directing gaseous fuel through the injet body to the first and second gas orifices. The first gas orifice is mounted to the injet body such that the first gas orifice is oriented for directing gaseous fuel from the gas passage towards the plurality of naturally aspirated flame ports. Gaseous fuel from the second gas orifice is flowable to the plurality of forced induction flame ports. A pneumatically actuated gas valve is adjustable between a closed configuration and an open configuration. The pneumatically actuated gas valve blocks a flow of gaseous fuel through the gas passage to the second gas orifice in the closed configuration. The pneumatically actuated gas valve is configured to adjust from the closed configuration to the open configuration in response to a flow of air through the air passage. A flow restriction body is positioned within the injet body. The flow restriction body is disposed within the air passage upstream of the pneumatically actuated gas valve. The flow restriction body defines a through hole. The flow of air through the air passage passes through the flow restriction body via the through hole.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

DETAILED DESCRIPTION

Figure 1:
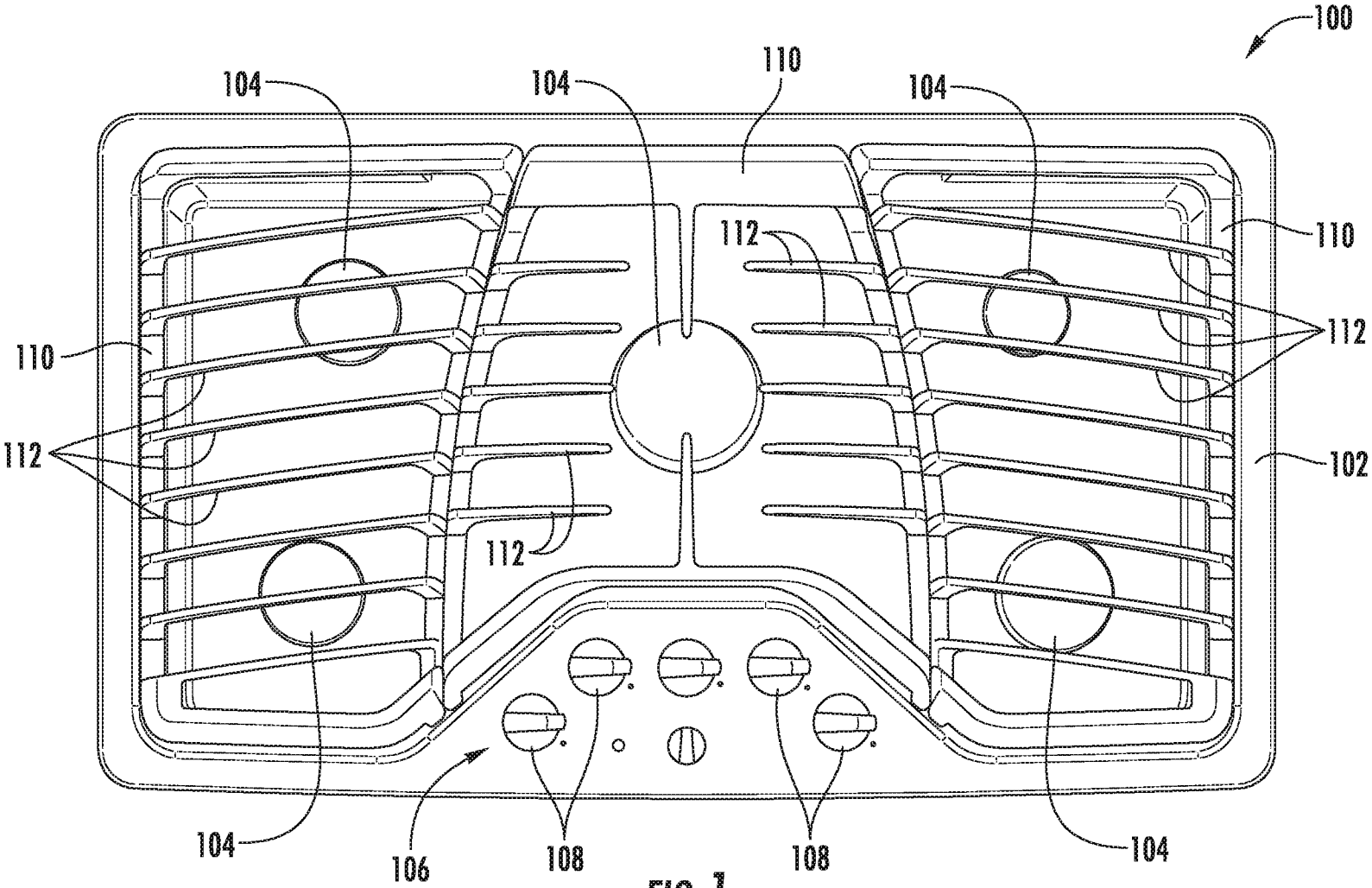
FIG. 1 provides a top, plan view of a cooktop appliance according to an example embodiment of the present disclosure.
Figure 2:
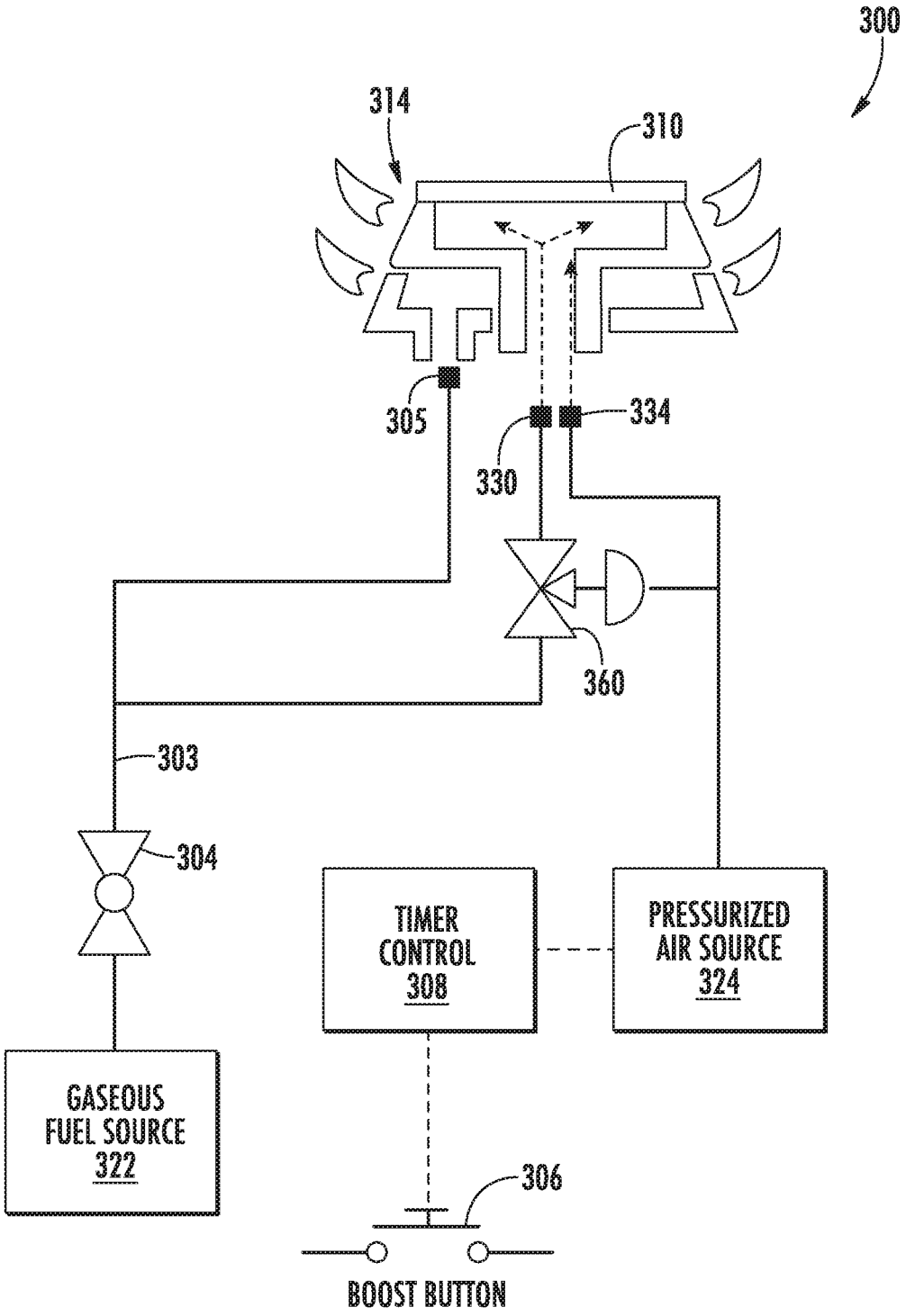
FIG. 2 is a schematic view of a gas burner according to an example embodiment of the present disclosure.
Figure 3:
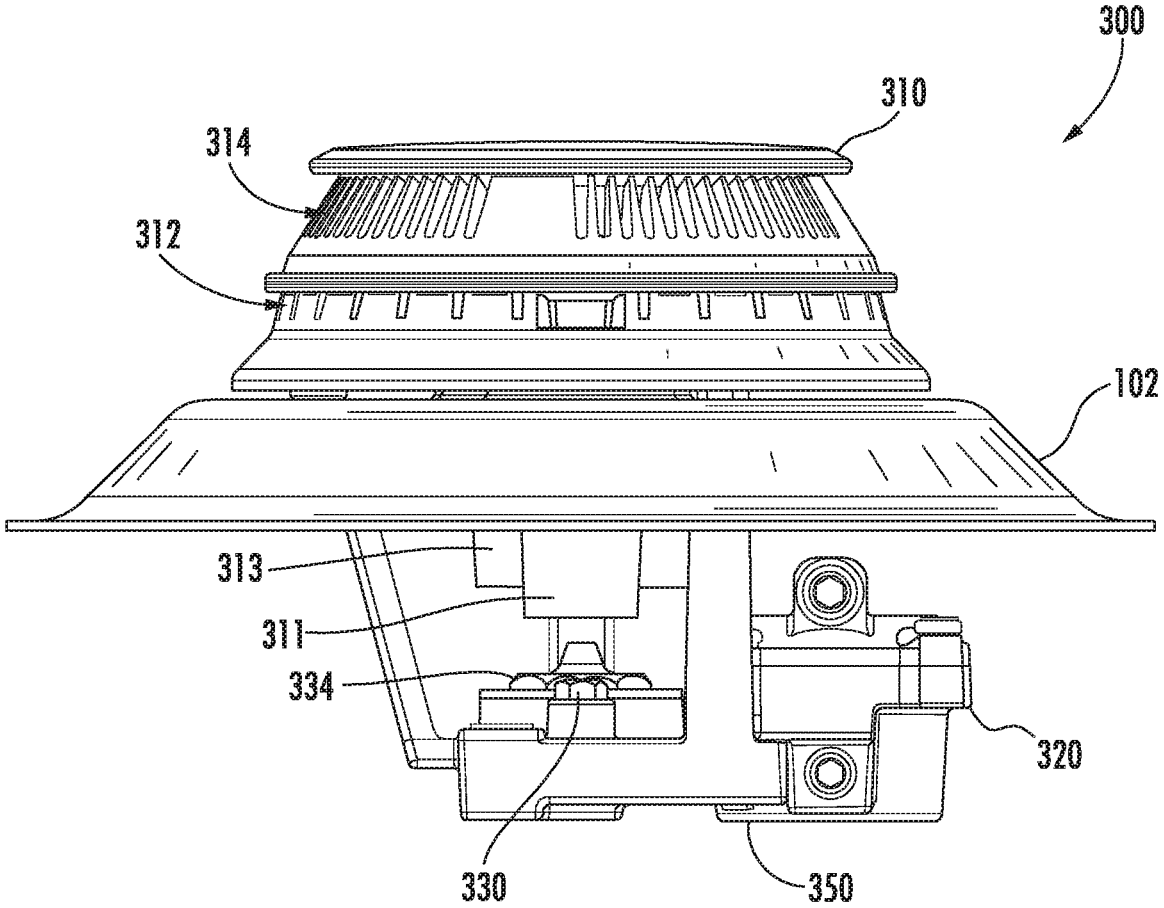
FIG. 3 is a side elevation view of the example gas burner of FIG. 2.
Figure 4:
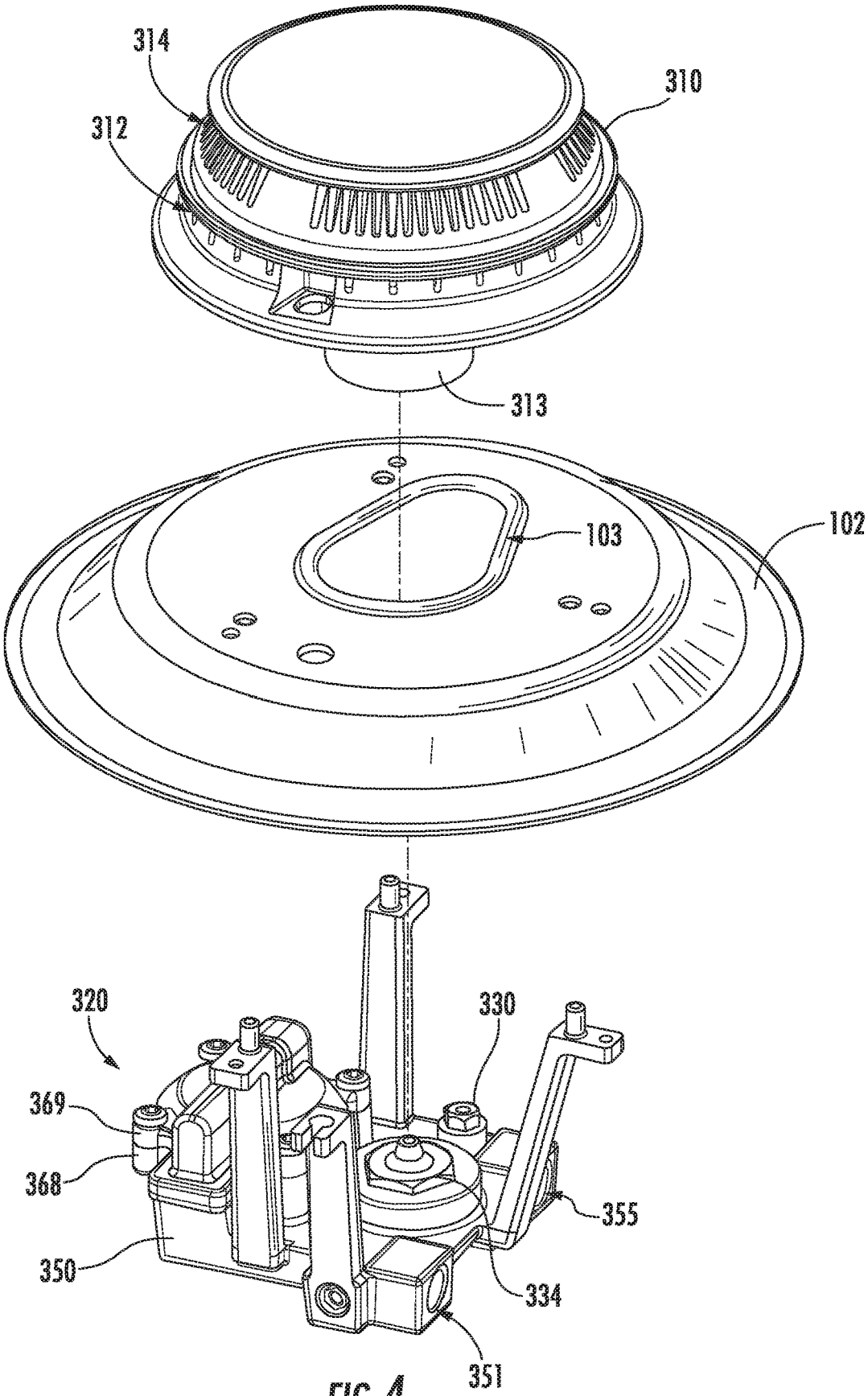
FIG. 4 is an exploded view of the example gas burner of FIG. 2.
Figure 5:
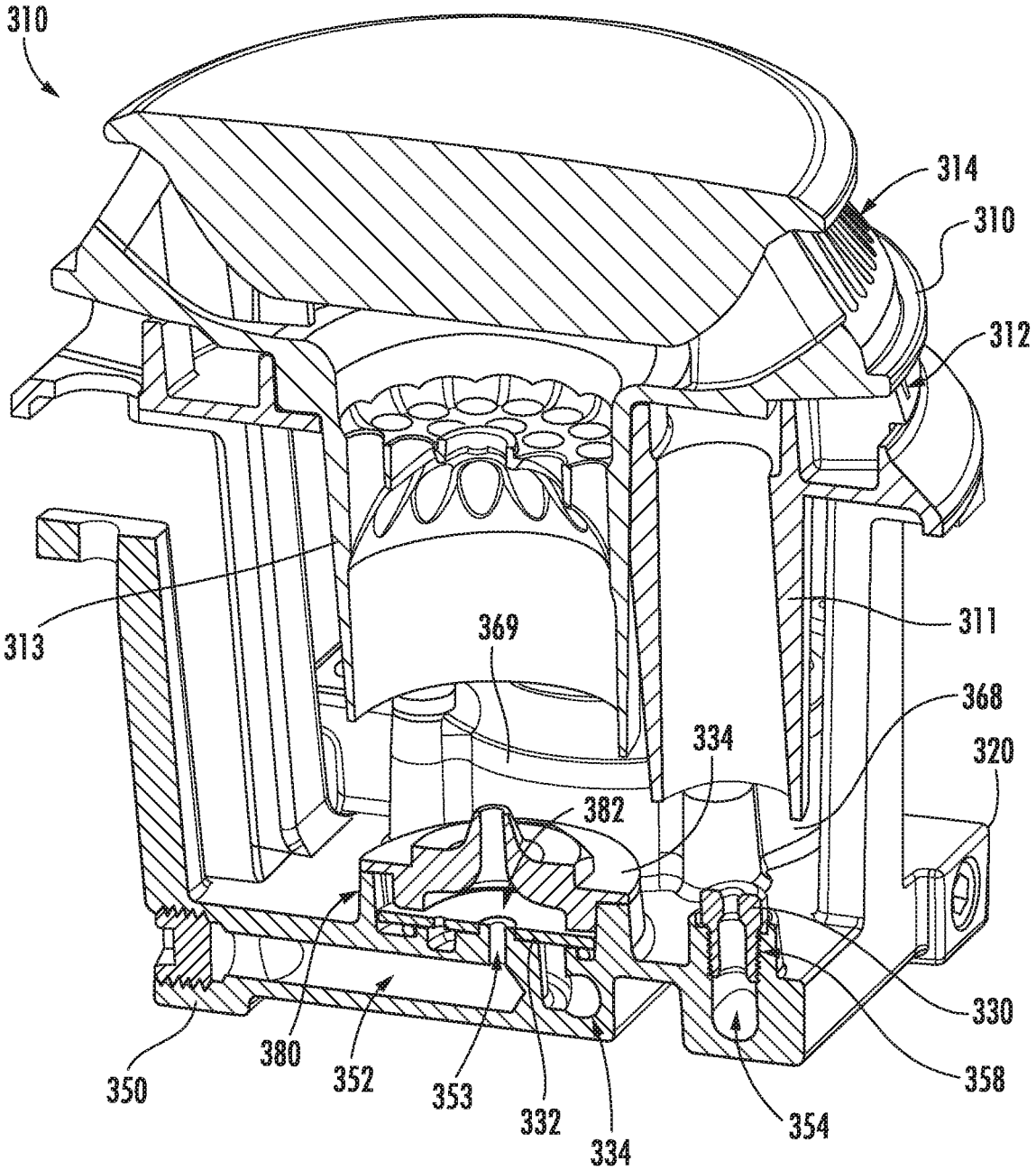
FIG. 5 is a section view of the example gas burner of FIG. 2.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

The present disclosure relates generally to a gas burner for a cooktop appliance 100. Although cooktop appliance 100 is used below for the purpose of explaining the details of the present subject matter, it will be appreciated that the present subject matter may be used in or with any other suitable appliance in alternative example embodiments. For example, the gas burner described below may be used on other types of cooking appliances, such as single or double oven range appliances. Cooktop appliance 100 is used in the discussion below only for the purpose of explanation, and such use is not intended to limit the scope of the present disclosure to any particular style of appliance.

FIG. 1 illustrates an example embodiment of a cooktop appliance 100 of the present disclosure. Cooktop appliance 100 may be, e.g., fitted integrally with a surface of a kitchen counter or may be configured as a slide-in cooktop unit. Cooktop appliance 100 includes a top panel 102 that includes one or more heating sources, such as heating elements 104 for use in, e.g., heating or cooking. In general, top panel 102 may be constructed of any suitably rigid and heat resistant material capable of supporting heating elements 104, cooking utensils, grates 110, and/or other components of cooktop appliance 100. By way of example, top panel 102 may be constructed of enameled steel, stainless steel, glass, ceramics, and combinations thereof.

According to the illustrated example embodiment, a user interface panel or control panel 106 is located within convenient reach of a user of cooktop appliance 100. For this example embodiment, control panel 106 includes control knobs 108 that are each associated with one of heating elements 104. Control knobs 108 allow the user to activate each heating element 104 and regulate the amount of heat input each heating element 104 provides to a cooking utensil located thereon, as described in more detail below. Although cooktop appliance 100 is illustrated as including control knobs 108 for controlling heating elements 104, it will be understood that control knobs 108 and the configuration of cooktop appliance 100 shown in FIG. 1 is provided by way of example only. More specifically, control panel 106 may include various input components, such as one or more of a variety of touch-type controls, electrical, mechanical or electro-mechanical input devices including rotary dials, push buttons, and touch pads.

Cooktop appliance 100 is generally referred to as a "gas cooktop," and heating elements 104 are gas burners. For example, one or more of the gas burners in cooktop appliance may be a gas burner 300 described below. As illustrated, heating elements 104 are positioned on and/or within top panel 102 and have various sizes, as shown in FIG. 1, so as to provide for the receipt of cooking utensils (i.e., pots, pans, etc.) of various sizes and configurations and to provide different heat inputs for such cooking utensils. In addition, cooktop appliance 100 may include one or more grates 110 configured to support a cooking utensil, such as a pot, pan, etc. In general, grates 110 include a plurality of elongated members 112, e.g., formed of cast metal, such as cast iron. The cooking utensil may be placed on the elongated members 112 of each grate 110 such that the cooking utensil rests on an upper surface of elongated members 112 during the cooking process. Heating elements 104 are positioned underneath the various grates 110 such that heating elements 104 provide thermal energy to cooking utensils above top panel 102 by combustion of fuel below the cooking utensils.

Turning now to FIGS. 2 through 9, a gas burner 300 according to an example embodiment of the present disclosure is described. Gas burner 300 may be used in cooktop appliance 100, e.g., as one of heating elements 104. Thus, gas burner 300 is described in greater detail below in the context of cooktop appliance 100. However, it will be understood that gas burner 300 may be used in or with any other suitable cooktop appliance in alternative example embodiments.

Gas burner 300 includes a burner body 310. Burner body 310 defines a plurality of naturally aspirated flame ports 312 and a plurality of forced induction flame ports 314. Naturally aspirated flame ports 312 may be distributed in a ring on burner body 310. Similarly, forced induction flame ports 314 may be distributed in a ring on burner body 310. Burner body 310 may also be stacked, e.g., such that forced induction flame ports 314 are positioned above naturally aspirated flame ports 312 on burner body 310. Thus, e.g., the ring of forced induction flame ports 314 may be positioned above the ring of naturally aspirated flame ports 312 on burner body 310. Burner body 310 may be positioned on top panel 102.

Naturally aspirated flame ports 312 may receive gaseous fuel from a gaseous fuel source 322, such as a natural gas line or propane line, when a user actuates one of control knobs 108 to adjust a control valve 304. Thus, e.g., a supply line 303 for naturally aspirated flame ports 312 may extend from gaseous fuel source 322 to an orifice 305 for naturally aspirated flame ports 312, and control valve 304 may be coupled to supply line 303.

Forced induction flame ports 314 may be plumbed in parallel to naturally aspirated flame ports 312 in gas burner 300. Thus, forced induction flame ports 314 may be capable of receiving gaseous fuel from gaseous fuel source 322 when the user actuates one of control knobs 108 to adjust control valve 304. Gas burner 300 also includes features for supplying air from a pressurized air source 324, such as an air pump or fan, to forced induction flame ports 314. Thus, forced induction flame ports 314 may operate with a higher flow rate of gaseous fuel and/or air compared to naturally aspirated flame ports 312. As an example, forced induction flame ports 314 may be activated by pressing a boost burner button 306 on control panel 106. In response to a user actuating boost burner button 306, pressurized air source 324 may be activated, e.g., with a timer control 308. Gas burner 300 also includes features for blocking the flow of gaseous fuel to forced induction flame ports 314 unless pressurized air source 324 is activated and/or pressurized air is suppled to forced induction flame ports 314, as discussed in greater detail below.

With reference to FIGS. 3 through 9, gas burner 300 also includes an injet assembly 320. Injet assembly 320 may be positioned below top panel 102, e.g., below an opening 103 of top panel 102. Conversely, burner body 310 may be positioned on top panel 102, e.g., over opening 103 of top panel 102. Thus, burner body 310 may cover opening 103 of top panel 102 when burner body 310 is positioned on top panel 102. When burner body 310 is removed from top panel 102, injet assembly 320 below top panel 102 is accessible through opening 103. Thus, e.g., a fuel orifice(s) of gas burner 300 on injet assembly 320 may be accessed by removing burner body 310 from top panel 102, and an installer may reach through opening 103 (e.g., with a wrench or other suitable tool) to change out the fuel orifice(s) of gas burner 300.

Injet assembly 320 is configured for directing a flow of gaseous fuel to naturally aspirated flame ports 312 of burner body 310. Thus, injet assembly 320 may be coupled to gaseous fuel source 322. During operation of gas burner 300, gaseous fuel from gaseous fuel source 322 may flow from injet assembly 320 into a vertical Venturi mixing tube 311. In particular, injet assembly 320 includes a first gas orifice 330 that is in fluid communication with a gas passage 354. A jet of gaseous fuel from gaseous fuel source 322 may exit injet assembly 320 at first gas orifice 330 and flow towards vertical Venturi mixing tube 311. Between first gas orifice 330 and vertical Venturi mixing tube 311, the jet of gaseous fuel from first gas orifice 330 may entrain air into vertical Venturi mixing tube 311. Air and gaseous fuel may mix within vertical Venturi mixing tube 311 prior to flowing to naturally aspirated flame ports 312 where the mixture of air and gaseous fuel may be combusted.

Injet assembly 320 is also configured for directing a flow of air and gaseous fuel to forced induction flame ports 314 of burner body 310. Thus, as discussed in greater detail below, injet assembly 320 may be coupled to pressurized air source 324 in addition to gaseous fuel source 322. During boosted operation of gas burner 300, a mixed flow of gaseous fuel from gaseous fuel source 322 and air from pressurized air source 324 may flow from injet assembly 320 into an inlet tube 313 prior to flowing to forced induction flame ports 314 where the mixture of gaseous fuel and air may be combusted at forced induction flame ports 314.

In addition to first gas orifice 330, injet assembly 320 also includes a second gas orifice 332, a mixed outlet nozzle 334 and an injet body 350. Injet body 350 defines an air passage 352 and a gas passage 354. Air passage 352 may be in fluid communication with pressurized air source 324. For example, a pipe or conduit may extend between pressurized air source 324 and injet body 350, and pressurized air from pressurized air source 324 may flow into air passage 352 via such pipe or conduit. Gas passage 354 may be in fluid communication with gaseous fuel source 322. For example, a pipe or conduit may extend between gaseous fuel source 322 and injet body 350, and gaseous fuel from gaseous fuel source 322 may flow into gas passage 354 via such pipe or conduit. In certain example embodiments, injet body 350 defines a single inlet 351 for air passage 352 through which the pressurized air from pressurized air source 324 may flow into air passage 352, and injet body 350 defines a single inlet 355 for gas passage 354 through which the pressurized air from gaseous fuel source 322 may flow into gas passage 354.

First gas outlet orifice 330 is mounted to injet body 350, e.g., at a first outlet 358 of gas passage 354. Thus, gaseous fuel from gaseous fuel source 322 may exit gas passage 354 through first gas outlet orifice 330, and gas passage 354 is configured for directing a flow of gaseous fuel through injet body 350 to first gas outlet orifice 330. On injet body 350, first gas outlet orifice 330 is oriented for directing a flow of gaseous fuel towards vertical Venturi mixing tube 311 and/or naturally aspirated flame ports 312, as discussed above.

Second gas orifice 332 and injet body 350, e.g., collectively, form an eductor mixer 380 within a mixing chamber 382 of injet body 350. Eductor mixer 380 is configured for mixing pressurized air from air passage 352 with gaseous fuel from gas passage 354 in mixing chamber 382. In particular, an outlet 353 of air passage 352 is positioned at mixing chamber 382. A jet of pressurized air from pressurized air source 324 may flow from air passage 352 into mixing chamber 382 via outlet 353 of air passage 352. Second gas orifice 332 is positioned within injet body 350 between mixing chamber 382 and gas passage 354. Gaseous fuel from gaseous fuel source 322 may flow from gas passage 354 into mixing chamber 382 via second gas orifice 332. As an example, second gas orifice 332 may be a plate that defines a plurality of through holes 333, and the gaseous fuel in gas passage 354 may flow through holes 333 into mixing chamber 382.

The jet of pressurized air flowing into mixing chamber 382 via outlet 353 of air passage 352 may draw and entrain gaseous fuel flowing into mixing chamber 382 via second gas orifice 332. In addition, as the gaseous fuel is entrained into the air, a mixture of air and gaseous fuel is formed within mixing chamber 382. From mixing chamber 382, the mixture of air and gaseous fuel may flow from mixing chamber 382 via mixed outlet nozzle 334. In particular, mixed outlet nozzle 334 is mounted to injet body 350 at mixing chamber 382, and mixed outlet nozzle 334 is oriented on injet body 350 for directing the mixed flow of air and gaseous fuel from mixing chamber 382 into inlet tube 313 and/or towards forced induction flame ports 314, as discussed above.

Burner body 310 may be positioned over injet body 350, e.g., when burner body 310 is positioned top panel 102. In addition, first gas orifice 330 may be oriented on injet body 350 such that first gas orifice 330 directs the flow of gaseous fuel upwardly towards vertical Venturi mixing tube 311 and naturally aspirated flame ports 312. Similarly, mixed outlet nozzle 334 may be oriented on injet body 350 such that mixed outlet nozzle 334 directs the mixed flow of air and gaseous fuel upwardly towards inlet tube 313 and forced induction flame ports 314.

First and second gas orifices 330, 332 may be removeable from injet body 350. First and second gas orifices 330, 332 may also be positioned on injet body 350 directly below burner body 310, e.g., when burner body 310 is positioned on top panel 102. Thus, e.g., first and second gas orifices 330, 332 may be accessed by removing burner body 310 from top panel 102, and an installer may reach through opening 103 (e.g., with a wrench or other suitable tool) to change out first and second gas orifices 330, 332.

Injet assembly 320 also includes a pneumatically actuated gas valve 360. Pneumatically actuated gas valve 360 may be positioned within injet body 350, and pneumatically actuated gas valve 360 is adjustable between a closed configuration and an open configuration. In the closed configuration, pneumatically actuated gas valve 360 blocks the flow of gaseous fuel through gas passage 354 to second gas orifice 332, eductor mixer 380 and/or mixed outlet nozzle 334. Conversely, pneumatically actuated gas valve 360 permits the flow of gaseous fuel through gas passage 354 to second gas orifice 332/eductor mixer 380 in the open configuration. Pneumatically actuated gas valve 360 is configured to adjust from the closed configuration to the open configuration in response to the flow of air through air passage 352 to outlet 353 of air passage 352. Thus, e.g., pneumatically actuated gas valve 360 is in fluid communication with air passage 352 and opens in response to air passage 352 being pressurized by air from pressurized air source 324. As an example, pneumatically actuated gas valve 360 may be positioned on a branch of air passage 352 relative to outlet 353 of air passage 352.

It will be understood that first gas outlet orifice 330 may be in fluid communication with gas passage 354 in both the open and closed configurations of pneumatically actuated gas valve 360. Thus, first gas outlet orifice 330 may be positioned on gas passage 354 upstream of pneumatically actuated gas valve 360 relative to the flow of gas through gas passage 354. Thus, e.g., pneumatically actuated gas valve 360 may not regulate the flow of gas through second gas orifice 332 but not first gas outlet orifice 330.

Figure 6:
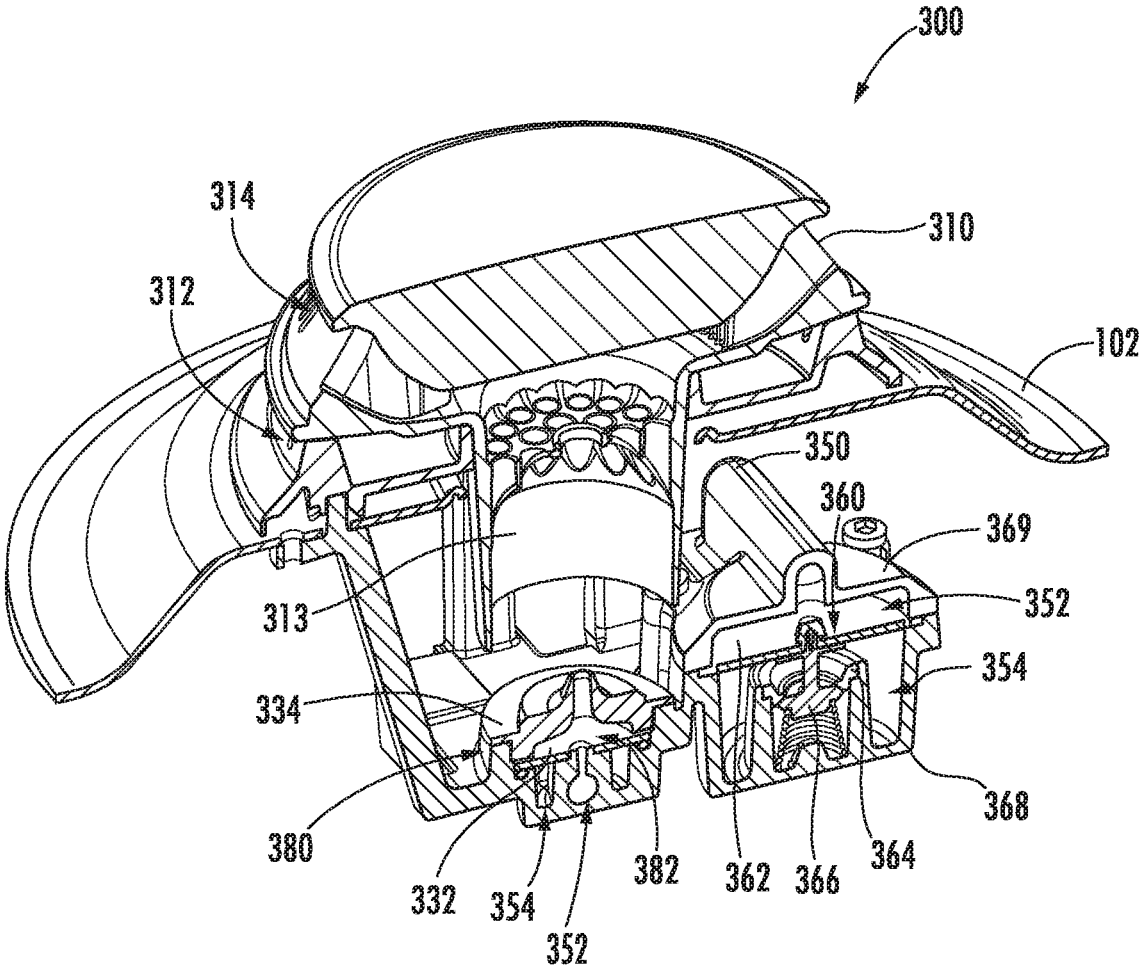
FIG. 6 is another section view of the example gas burner of FIG. 2.
Figure 7:
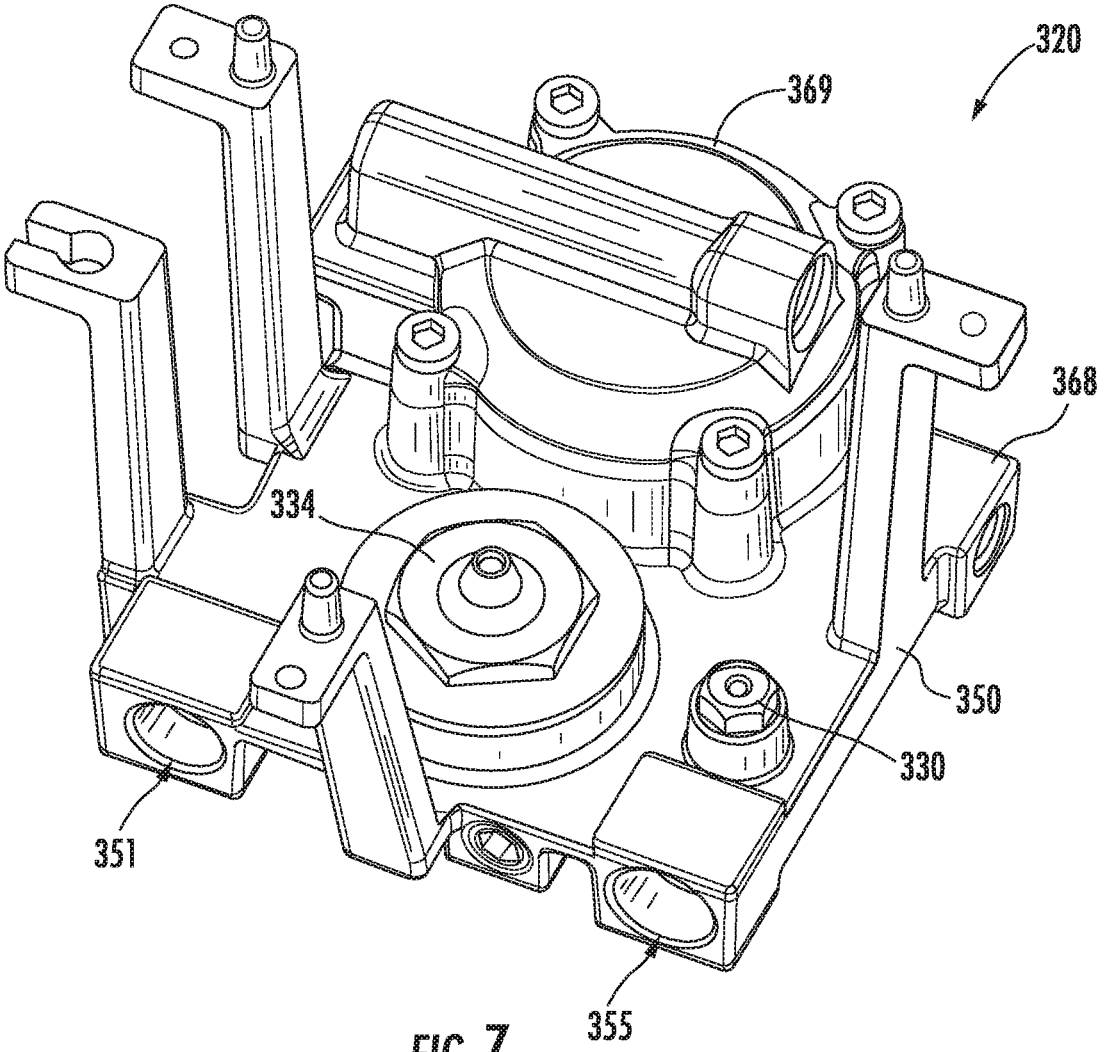
FIG. 7 is a perspective view of an injet of the example gas burner of FIG. 2.
Figure 8:
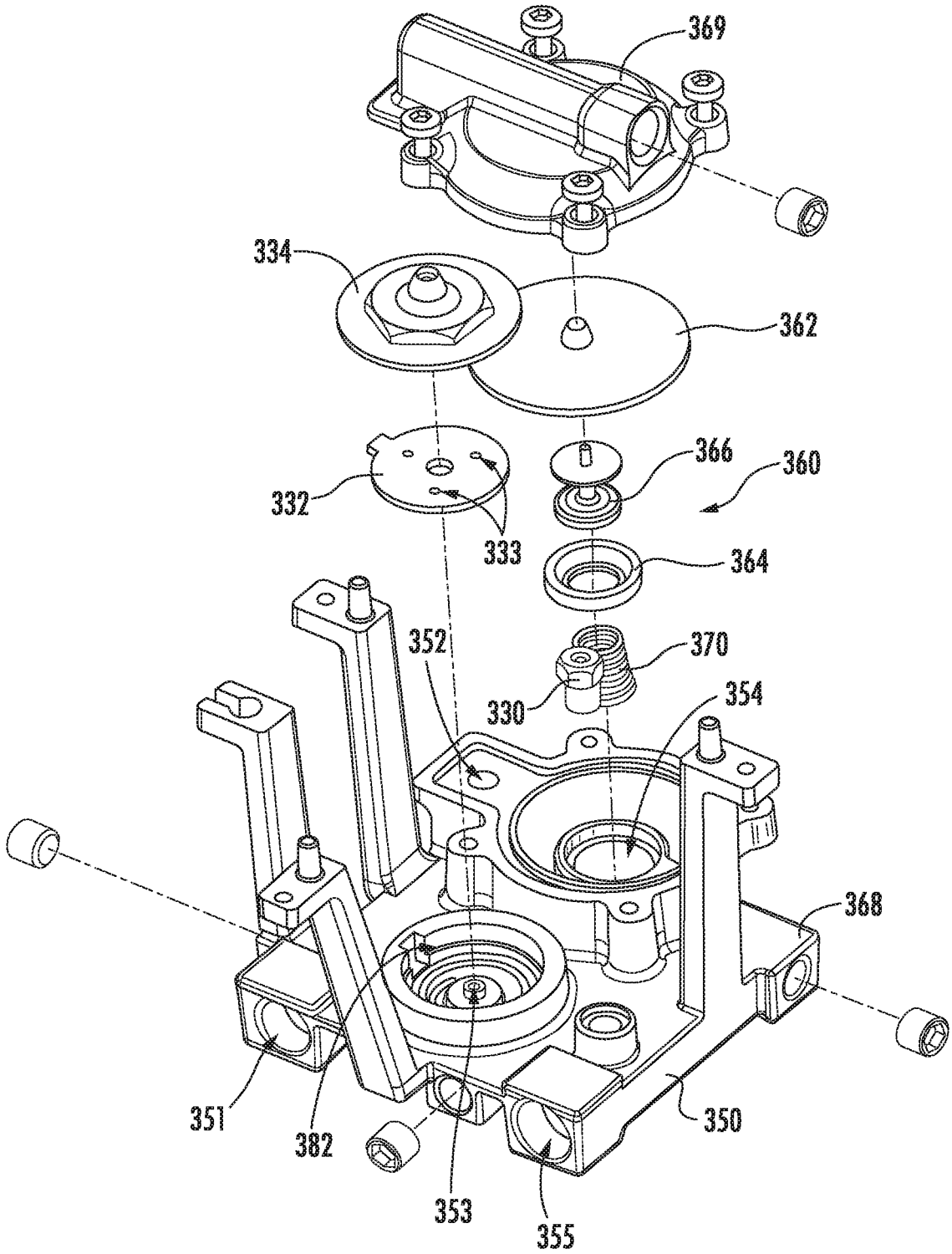
FIG. 8 is an exploded view of the injet of FIG. 7.
Figure 9:
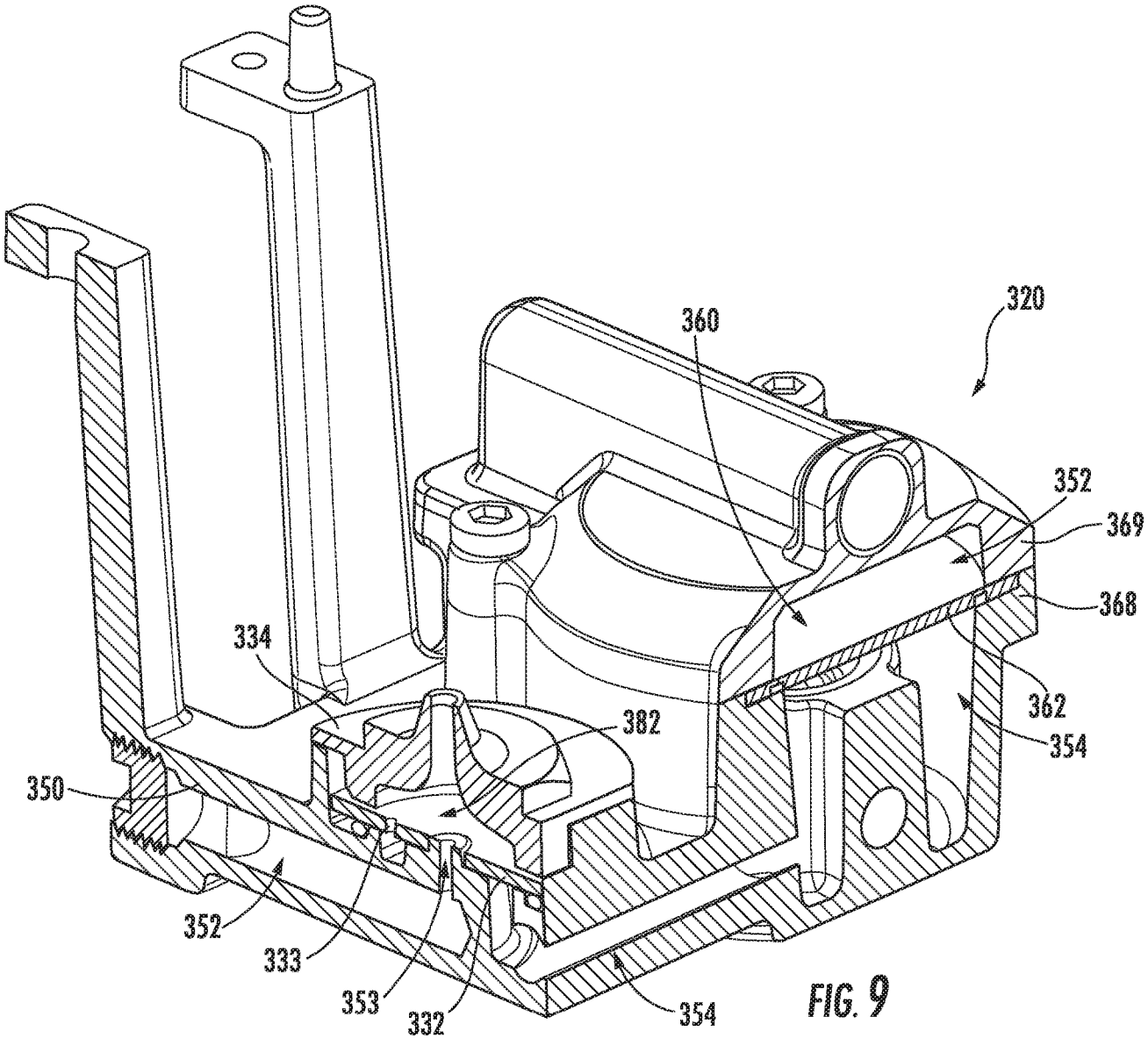
FIG. 9 is a section view of the injet of FIG. 7.

As shown in FIGS. 6 and 8, pneumatically actuated gas valve 360 includes a diaphragm 362, a seal 364 and a plug 366. Diaphragm 362 is positioned between air passage 352 and gas passage 354 within injet body 350. For example, diaphragm 362 may be circular and may be clamped between a first injet body half 368 and a second injet body half 369. In particular, first and second injet body halves 368, 369 may be fastened together with diaphragm 362 positioned between first and second injet body halves 368, 369.

Seal 364 is mounted to injet body 350 within gas passage 354. Plug 366 is mounted to diaphragm 362, e.g., such that plug 366 travels with diaphragm 362 when diaphragm 362 deforms. Plug 366 is positioned against seal 364 when pneumatically actuated gas valve 360 is closed. A spring 370 may be coupled to plug 366. Spring 370 may urge plug 366 towards seal 364. Thus, pneumatically actuated gas valve 360 may be normally closed.

When air passage 352 is pressurized by air from pressurized air source 324, diaphragm 362 may deform due to the pressure of air in air passage 352 increasing, and plug 366 may shift away from seal 364 as diaphragm 362 deforms. In such a manner, diaphragm 362, seal 364 and plug 366 may cooperate to open pneumatically actuated gas valve 360 in response to air passage 352 being pressurized by air from pressurized air source 324. Conversely, diaphragm 362 may return to an undeformed state when air passage 352 is no longer pressurized by air from pressurized air source 324, and plug 366 may shift against seal 364. In such a manner, diaphragm 362, seal 364 and plug 366 may cooperate to close pneumatically actuated gas valve 360 in response to air passage 352 no longer being pressurized by air from pressurized air source 324.

As may be seen from the above, gas burner 300 includes a compact injet assembly 320. Thus, an installation footprint and/or required plumbing for gas burner 300 within cooktop appliance 100 may be reduced compared to known gas burners.

As noted above, diaphragm 362 returns to the undeformed state of diaphragm 362 when pressurized air source 324 shut offs and air passage 352 is no longer pressurized by air from pressurized air source 324. Such motion of diaphragm 362 may generate a temporary suction or vacuum pressure condition in gas passage 354. Thus, e.g., when an associated control knob 108 on control valve 304 is quickly turned down from the boosted mode to a minimum operating rate (simmer position), very little gaseous fuel from gaseous fuel source 322 is entering gas passage 354 and the transient vacuum pressure temporarily urges the gaseous fuel in gas passage 354 away from first gas orifice 330. Such condition can extinguish flames at naturally aspirated flame ports 312. As discussed in greater detail below, gas burner 300 includes features for delaying or slowing down the rate at which diaphragm 362 is closable. Such features may reduce or minimize transient pressure swings when the pressurized air source 324 shut offs and diaphragm 362 deforms.

Figure 10:
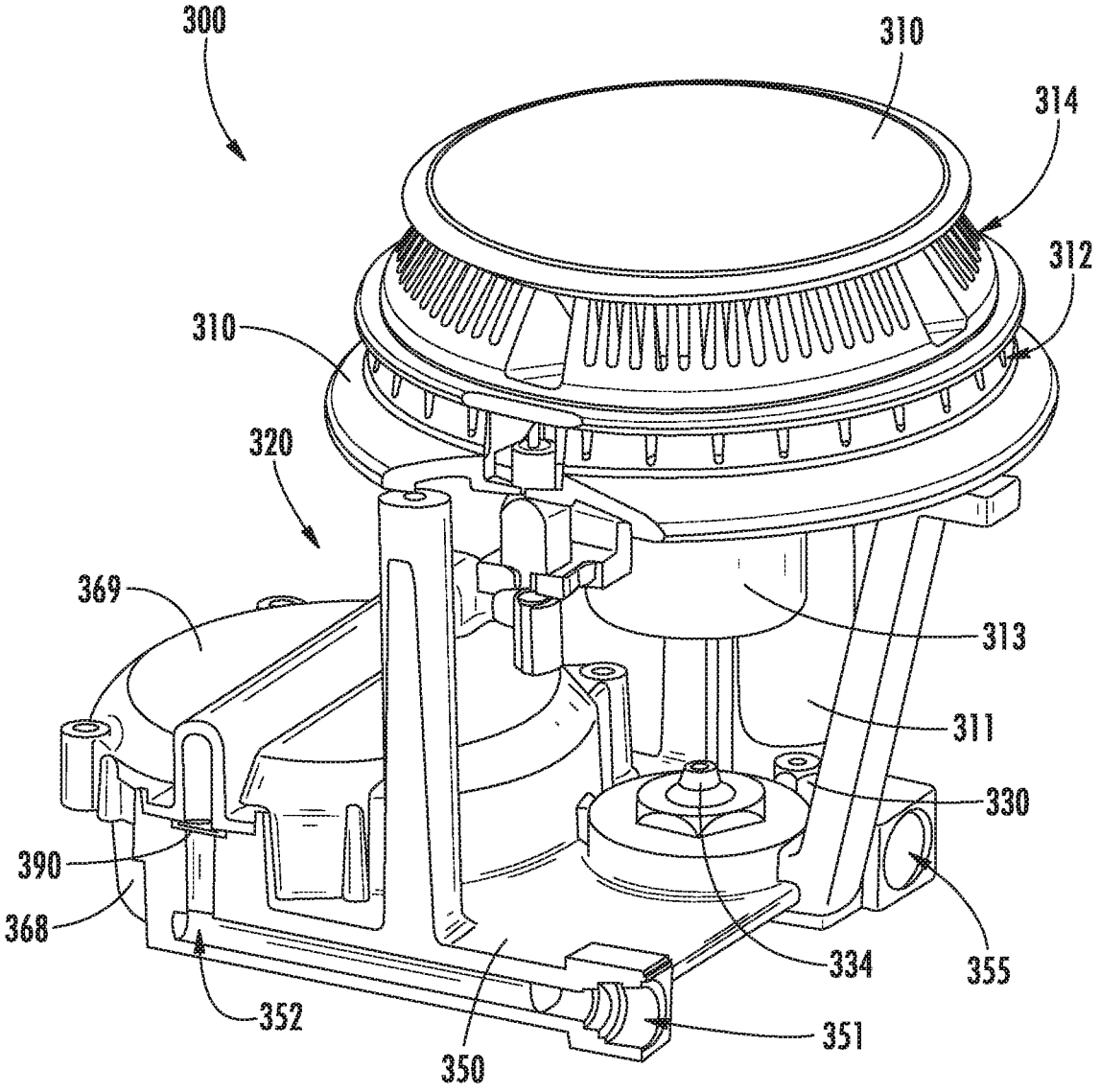
FIG. 10 is another section view of the example gas burner of FIG. 2.
Figure 11:
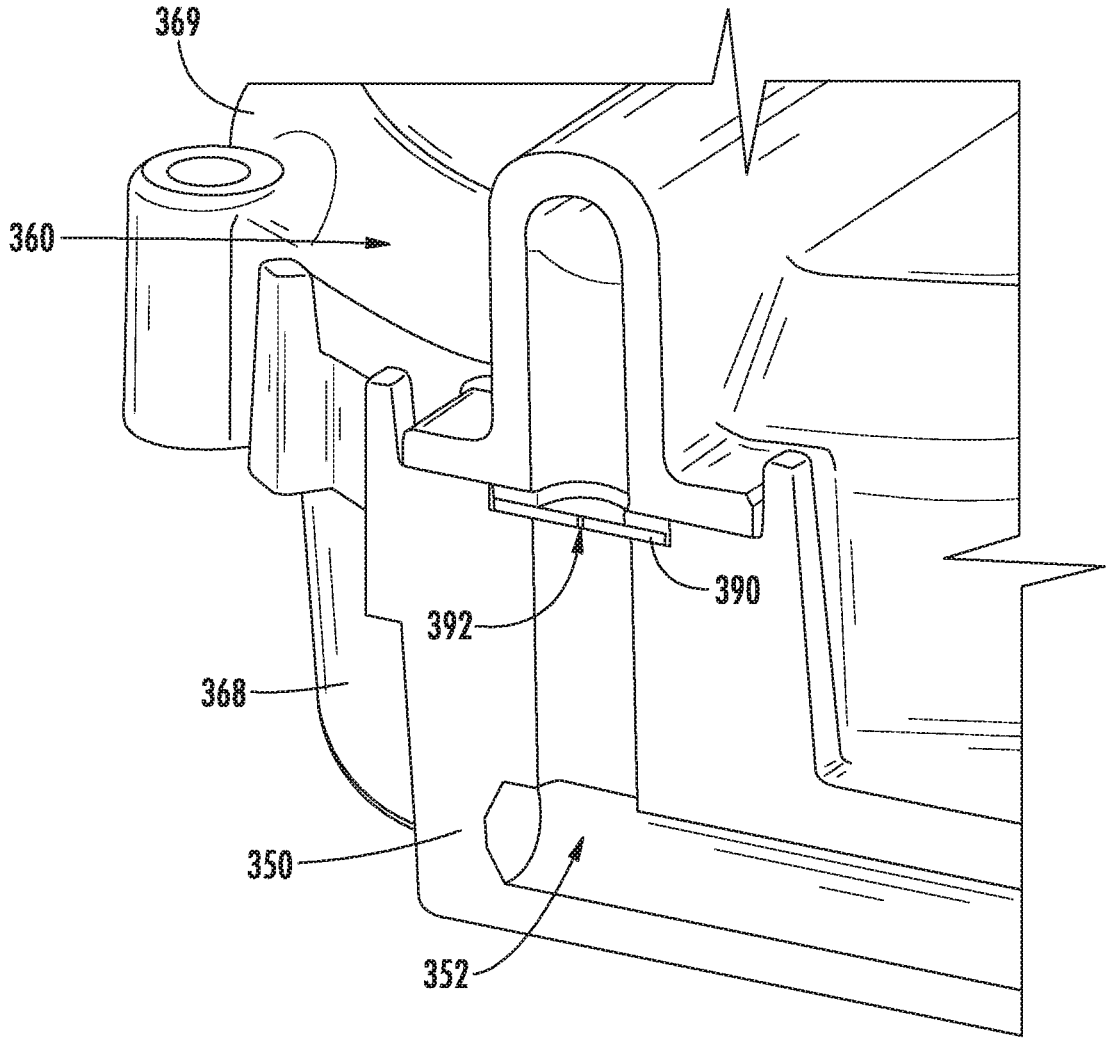
FIG. 11 is a partial, section view of the example gas burner of FIG. 10.

FIG. 10 is another section view of gas burner 300. FIG. 11 is a partial, section view of gas burner 300. As may be seen in FIGS. 10 and 11, gas burner 300 includes a flow restriction body 390. Flow restriction body 390 is disposed upstream of pneumatically actuated gas valve 360, e.g., relative to the flow of air from pressurized air source 324. Flow restriction body 390 defines a through hole 392 via which air, e.g., from pressurized air source 324, is flowable to pneumatically actuated gas valve 360. While shown with one through hole 392 in FIGS. 10 and 11, it will be understood that flow restriction body 390 may define two or more through holes 392 in alternative example embodiments.

Through hole 392 restricts the flow of air within air passage 352 to pneumatically actuated gas valve 360. For example, through hole 392 may be sized to create substantial flow resistance for air within air passage 352 flowing to pneumatically actuated gas valve 360 while also allowing fluid communication between pressurized air source 324 and pneumatically actuated gas valve 360. In particular, through hole 392 may be sized to create a choked flow condition within air passage 352 when subjected to significant pressure drops across flow restriction body 390 and through hole 392. Thus, e.g., the rate at which diaphragm 362 returns to the undeformed state of diaphragm 362 when pressurized air source 324 shut offs and air passage 352 is no longer pressurized by air from pressurized air source 324 is throttled by flow restriction body 390, e.g., relative to when flow restriction body 390 is removed. Such throttling may allow fuel pressure at simmer settings of gas burner 300 to maintain a gage pressure state within gas passage 354, e.g., during transition from the boosted mode to the normal mode. As a particular example, a width (e.g., diameter) of through hole 392 may be no less than one hundredth of an inch (0.01") and no greater than twenty-five thousandths of an inch (0.025") in certain example embodiments to provide the above described benefits. The width of through hole 392 is defined perpendicular the flow of air across flow restriction body 390 via through hole 392.

As shown in FIGS. 10 and 11, flow restriction body 390 may be positioned within injet body 350 in air passage 352 upstream of pneumatically actuated gas valve 360, e.g., diaphragm 362 of pneumatically actuated gas valve 360. Thus, the flow of air through air passage 352 may pass through flow restriction body 390 via through hole 392 prior to flowing to pneumatically actuated gas valve 360, e.g., diaphragm 362 of pneumatically actuated gas valve 360. In certain example embodiments, flow restriction body 390 may be a plate, and the plate may be clamped between first injet body half 368 and second injet body half 369, e.g., with diaphragm 362 of pneumatically actuated gas valve 360. Thus, flow restriction body 390 may be removable from injet body 350, e.g., by separating first and second injet body halves 368, 369, such that flow restriction body 390 may be serviced or replaced should through hole 392 clog or flow restriction body 390 otherwise requires servicing.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. An injet for a gas burner, comprising:

a first gas orifice;

a second gas orifice;

an injet body defining an air passage and a gas passage, the first and second gas orifices mounted to the injet body, the first gas orifice spaced from the second gas orifice on the injet body, the gas passage configured for directing gaseous fuel through the injet body to the first and second gas orifices;

a pneumatically actuated gas valve adjustable between a closed configuration and an open configuration, the pneumatically actuated gas valve blocking a flow of gaseous fuel through the gas passage to the second gas orifice in the closed configuration, the pneumatically actuated gas valve configured to adjust from the closed configuration to the open configuration in response to a flow of air through the air passage; and a flow restriction body disposed upstream of the pneumatically actuated gas valve, the flow restriction body defining a through hole via which air is flowable to pneumatically actuated gas valve, wherein the pneumatically actuated gas valve is positioned within the injet body.

2. The injet of claim 1, wherein the flow restriction body is positioned within the injet body in the air passage upstream of the pneumatically actuated gas valve, the flow of air through the air passage passing through the flow restriction body via the through hole.

3. The injet of claim 1, wherein the pneumatically actuated gas valve comprises:

a diaphragm positioned between the air passage and the gas passage within the injet body;

a seal mounted to the injet body within the gas passage; and a plug mounted to the diaphragm, the plug positioned against the seal in the closed configuration.

4. The injet of claim 3, wherein the diaphragm is a circular diaphragm.

5. The injet of claim 3, wherein the pneumatically actuated gas valve further comprises a spring coupled to the seal, the spring urging the plug towards the seal.

6. The injet of claim 3, wherein the injet body comprises an injet body base and an injet body cover, the diaphragm clamped between the injet body base and the injet body cover.

7. The injet of claim 6, wherein the flow restriction body comprises a flow restriction plate, and the flow restriction plate is clamped between the injet body base and the injet body cover.

8. The injet of claim 1, wherein the flow restriction body is positioned within the injet body, and the flow restriction body is removable from the injet body.

9. An injet for a gas burner, comprising:

a first gas orifice;

a second gas orifice;

an injet body defining an air passage and a gas passage, the first and second gas orifices mounted to the injet body, the first gas orifice spaced from the second gas orifice on the inj et body, the gas passage configured for directing gaseous fuel through the injet body to the first and second gas orifices;

a pneumatically actuated gas valve adjustable between a closed configuration and an open configuration, the pneumatically actuated gas valve blocking a flow of gaseous fuel through the gas passage to the second gas orifice in the closed configuration, the pneumatically actuated gas valve configured to adjust from the closed configuration to the open configuration in response to a flow of air through the air passage; and a flow restriction body disposed upstream of the pneumatically actuated gas valve, the flow restriction body defining a through hole via which air is flowable to pneumatically actuated gas valve, wherein a width of the through hole is no less than one hundredth of an inch and no greater than twenty-five thousandths of an inch.

10. A gas burner, comprising:

a burner body defining a plurality of naturally aspirated flame ports and a plurality of forced induction flame ports;

a first gas orifice;

a second gas orifice;

an injet body defining an air passage and a gas passage, the gas passage configured for directing gaseous fuel through the injet body to the first and second gas orifices, the first gas orifice mounted to the injet body such that the first gas orifice is oriented for directing gaseous fuel from the gas passage towards the plurality of naturally aspirated flame ports, gaseous fuel from the second gas orifice flowable to the plurality of forced induction flame ports;

a pneumatically actuated gas valve adjustable between a closed configuration and an open configuration, the pneumatically actuated gas valve blocking a flow of gaseous fuel through the gas passage to the second gas orifice in the closed configuration, the pneumatically actuated gas valve configured to adjust from the closed configuration to the open configuration in response to a flow of air through the air passage; and a flow restriction body positioned within the injet body, the flow restriction body disposed within the air passage upstream of the pneumatically actuated gas valve, the flow restriction body defining a through hole, the flow of air through the air passage passing through the flow restriction body via the through hole, wherein the pneumatically actuated gas valve is positioned within the injet body.

11. The gas burner of claim 10, wherein the flow restriction body is positioned within the injet body in the air passage upstream of the pneumatically actuated gas valve, the flow of air through the air passage passing through the flow restriction body via the through hole.

12. The gas burner of claim 10, wherein the pneumatically actuated gas valve comprises:

a diaphragm positioned between the air passage and the gas passage within the injet body;

a seal mounted to the injet body within the gas passage; and a plug mounted to the diaphragm, the plug positioned against the seal in the closed configuration.

13. The gas burner of claim 12, wherein the diaphragm is a circular diaphragm.

14. The gas burner of claim 12, wherein the pneumatically actuated gas valve further comprises a spring coupled to the seal, the spring urging the plug towards the seal.

15. The gas burner of claim 12, wherein the injet body comprises an injet body base and an injet body cover, the diaphragm clamped between the injet body base and the injet body cover.

16. The gas burner of claim 15, wherein the flow restriction body comprises a flow restriction plate, and the flow restriction plate is clamped between the injet body base and the injet body cover.

17. The gas burner of claim 10, wherein the flow restriction body is positioned within the injet body, and the flow restriction body is removable from the injet body.

18. The gas burner of claim 10, wherein a width of the through hole is no less than one hundredth of an inch and no greater than twenty-five thousandths of an inch.

* * * * *